US006399869B1

(12) United States Patent
Sagastegui

(10) Patent No.: US 6,399,869 B1
(45) Date of Patent: Jun. 4, 2002

(54) CADENCE-PROVIDING DRUM PRACTICE PAD ASSEMBLY AND METHOD

(76) Inventor: John Sagastegui, 2334 Ave. Marejada, San Clemente, CA (US) 92673

( * ) Notice: Subject to any disclaimer, the term of this patent is extended or adjusted under 35 U.S.C. 154(b) by 0 days.

(21) Appl. No.: 09/724,741

(22) Filed: Nov. 28, 2000

(51) Int. Cl.[7] ..... G10H 1/02

(52) U.S. Cl. ..... 84/738; 84/104; 84/111; 84/477 R; 84/600; 84/DIG. 12

(58) Field of Search ..... 84/48, 104, 111, 84/411 R, 477 R, 600, 712–714, 737–738, DIG. 12

(56) References Cited

U.S. PATENT DOCUMENTS 3,837,256 A 9/1974 Gullickson ..... 84/478
4,418,598 A * 12/1983 Klynas ..... 84/DIG. 12
4,479,412 A * 10/1984 Klynas ..... 84/DIG. 12
5,739,457 A * 4/1998 Devecka ..... 84/600
5,850,048 A * 12/1998 Ruf ..... 84/477 R
6,018,121 A * 1/2000 Devecka ..... 84/600
6,075,197 A * 6/2000 Chan ..... 84/DIG. 12

* cited by examiner

*Primary Examiner*—Marlon T. Fletcher
(74) *Attorney, Agent, or Firm*—Steins & Associates

(57) ABSTRACT

A Cadence-Providing Drum Practice Pad Assembly and Method is disclosed. The preferred assembly combines a practice pad and a cadence generating device in the same body. In other embodiments, the device provides visual prompting to the user on the striking pad. Furthermore, the device of the present invention includes a local repository of cadence programs, as well as the ability to retrieve and play cadence programs stored in remote cadence repositories, such as on a computer network or a portable storage media. Still further, the device includes the option of connecting remote striking pads that can be attached to a conventional drum set to provide visual and/or audible cadence prompting at the drums themselves. Furthermore, the device is attachable to a conventional cymbal or drum stand. The device may also have the ability to play musical accompaniment for the user's enjoyment.

18 Claims, 11 Drawing Sheets

CADENCE-PROVIDING DRUM PRACTICE PAD ASSEMBLY AND METHOD

BACKGROUND OF THE INVENTION

1. Field of the Invention

This invention relates generally to musical percussion instruments and, more specifically, to a Cadence-Providing Drum Practice Pad Assembly and Method 2. Description of Related Art A drum practice pad is commonly used by drummers and students of drumming to assist them in the development or honing of their drumming skills. As shown in FIG. 1, the conventional drum practice pad 10 comprises a flexible mat 12 (made typically from rubber) that is designed to be lain across a table or other flat surface (including a person's lap). Protruding from the top surface of the flexible mat 12 is a striking pad 14. The striking pad 14 typically consists of a hard core, such as from metal or wood, and a covering of the same material as the flexible mat 12.

In using the practice pad 10, the drummer strokes his drum sticks in a constant continuing formation, known as rudiments. These rudiments are stroking exercises which develop the drummer's speed, coordination, timing and technique. When learning to play a particular "drum line" (or drum portion of a piece of music) or rudiment, the drummer first listens to the rudiment or drum line, and then attempts to imitate it on the practice pad 10. This describes an audio learning process (i.e. first hearing a desired act, and then attempting to imitate it); the problem with this strictly audio learning process is that it has been proven to be substantially less effective than visual learning (i.e. first seeing the desired act, and then attempting to imitate it), or a combination of both audio and visual learning processes.

If we now turn to FIG. 2, we can examine another practice device for drummers. FIG. 2 is a perspective view of a conventional electronic drum synthesizer 16. The synthesizer 16 comprises a base 18, upon which are located a plurality of detector pads 20. When the user strikes one of the detector pads 20, the electronics built into the synthesizer 16 will generate a sound from built in speakers 22 (or output the sound signals to headphones or external sound amplification equipment). The synthesizer 16 can be programmed to provide many different sounds in response to the striking of each detector pad 20, and in some models, it can actually play music from its speakers (to which the drummer can play an accompaniment).

The functioning of the conventional synthesizer is depicted as a flow diagram 300 in FIG. 3. As can be seen, the user first strikes a detector pad 302, at which time the detector pad generates and output signal 304. The synthesizer logic (embedded in the electronics package of the synthesizer) receives the output signal from the detector pad 306. The synthesizer logic then converts the detector pad output signal to an audio signal 308. The problem with this device and system is that even though very high quality sounds can be produced, it does not really provide any additional benefit over the practice pad to the drummer in practicing or learning rudiments, since it too employs an audio learning process. What is needed is a drum practice system and method that employs visual learning techniques.

SUMMARY OF THE INVENTION

In light of the aforementioned problems associated with the prior devices and methods, it is an object of the present invention to provide a Cadence-Providing Drum Practice Pad Assembly and Method. The preferred assembly will combine a practice pad and a cadence generating device in the same body. It is an object that other embodiments provide visual prompting to the user on the striking pad. It is vet another object that the device of the present invention include a local repository of cadence programs, as well as the ability to retrieve and play cadence programs stored in remote cadence repositories such as on a computer network or a portable storage media. It is a further object that the device include the option of connecting remote striking pads that can be attached to a conventional drum set to provide visual and/or audible cadence prompting at the drums themselves. It is yet a further object that the device be attachable to a conventional cymbal or drum stand. It is a final object that the device include the ability to play musical accompaniment for the user's enjoyment.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Cadence-Providing Drum Practice Pad Assembly and Method.

Figure 1:
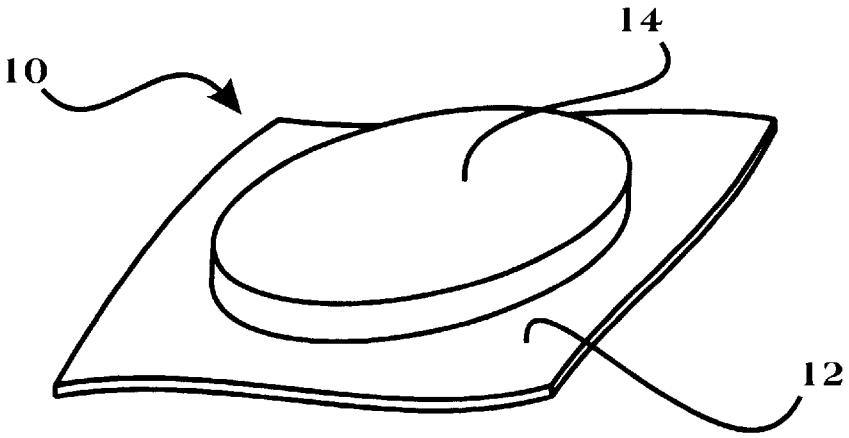
FIGURE 1 PRIOR ART
FIG. 1 is a perspective view of a conventional drum practice pad.
Figure 2:
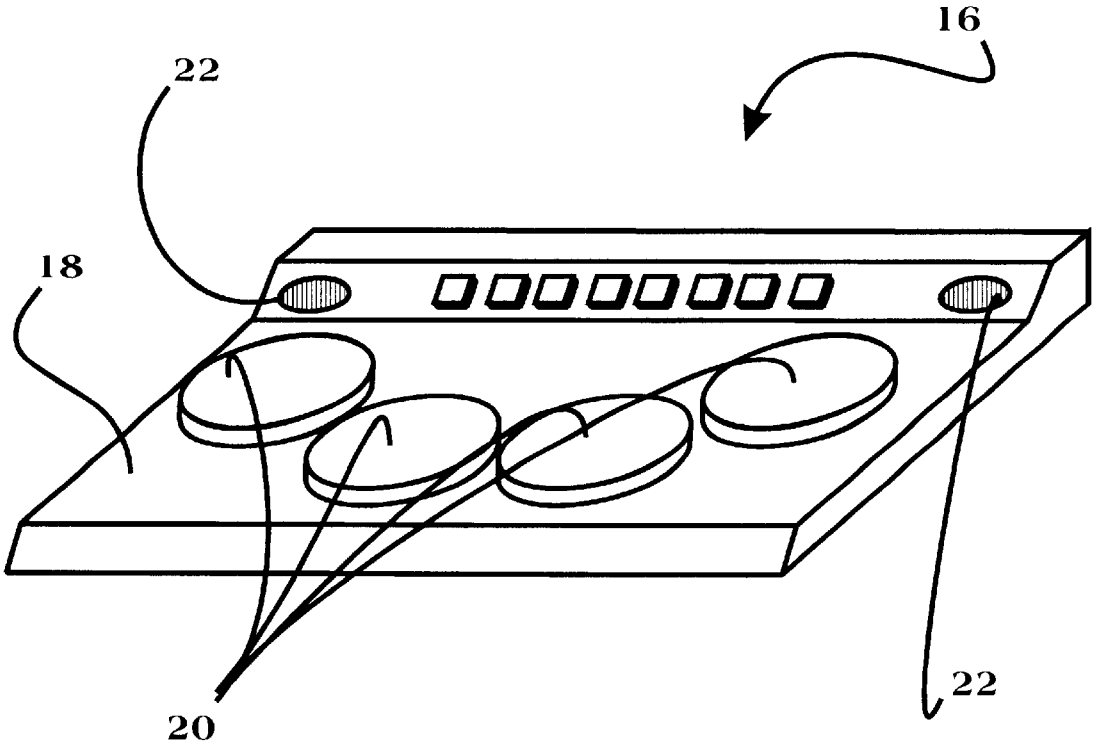
FIGURE 2 PRIOR ART
FIG. 2 is a perspective view of a conventional electronic drum synthesizer.
Figure 3:
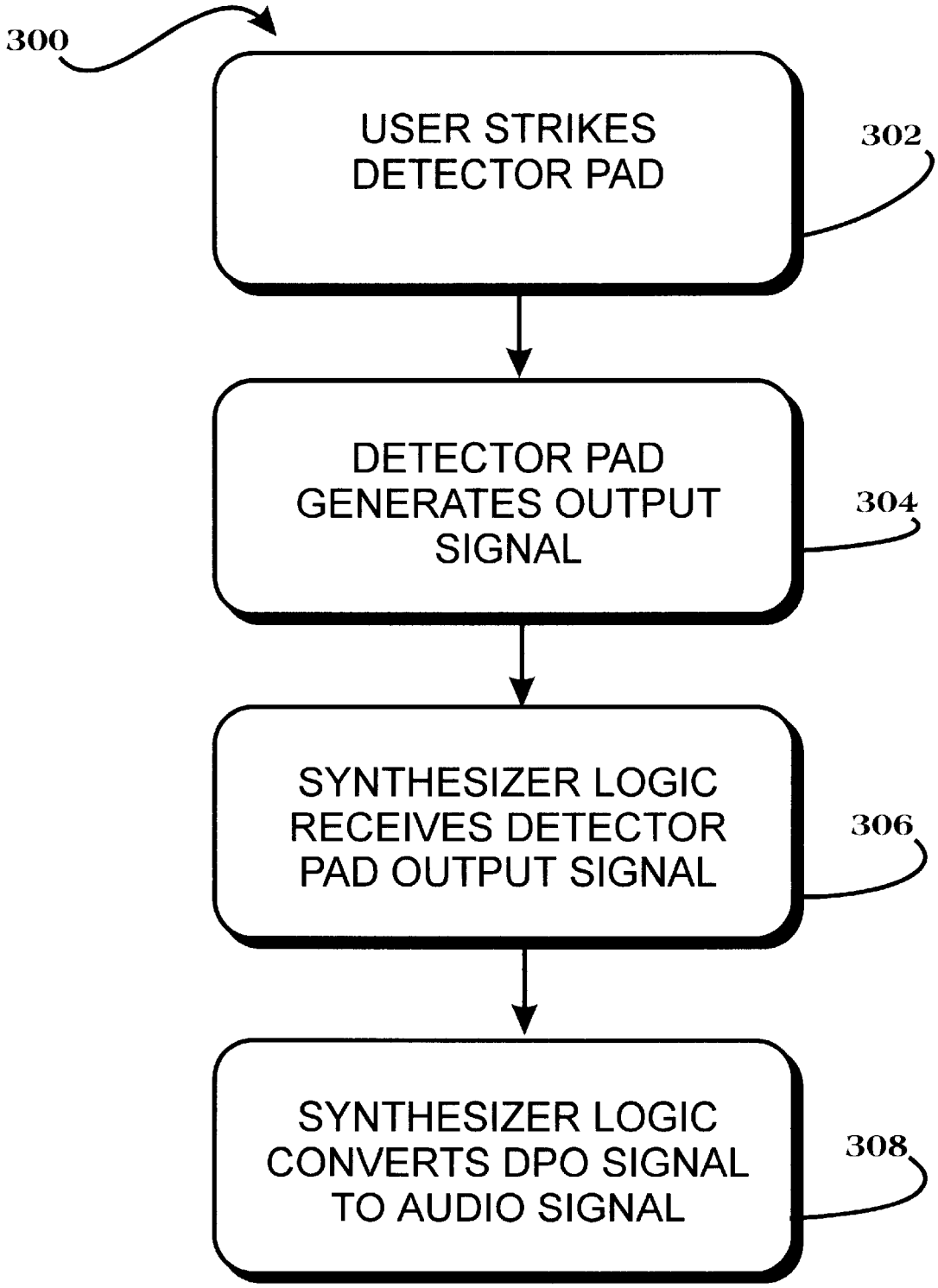
FIGURE 3 PRIOR ART
FIG. 3 depicts the operating process for a conventional drum synthesizer.
Figure 4:
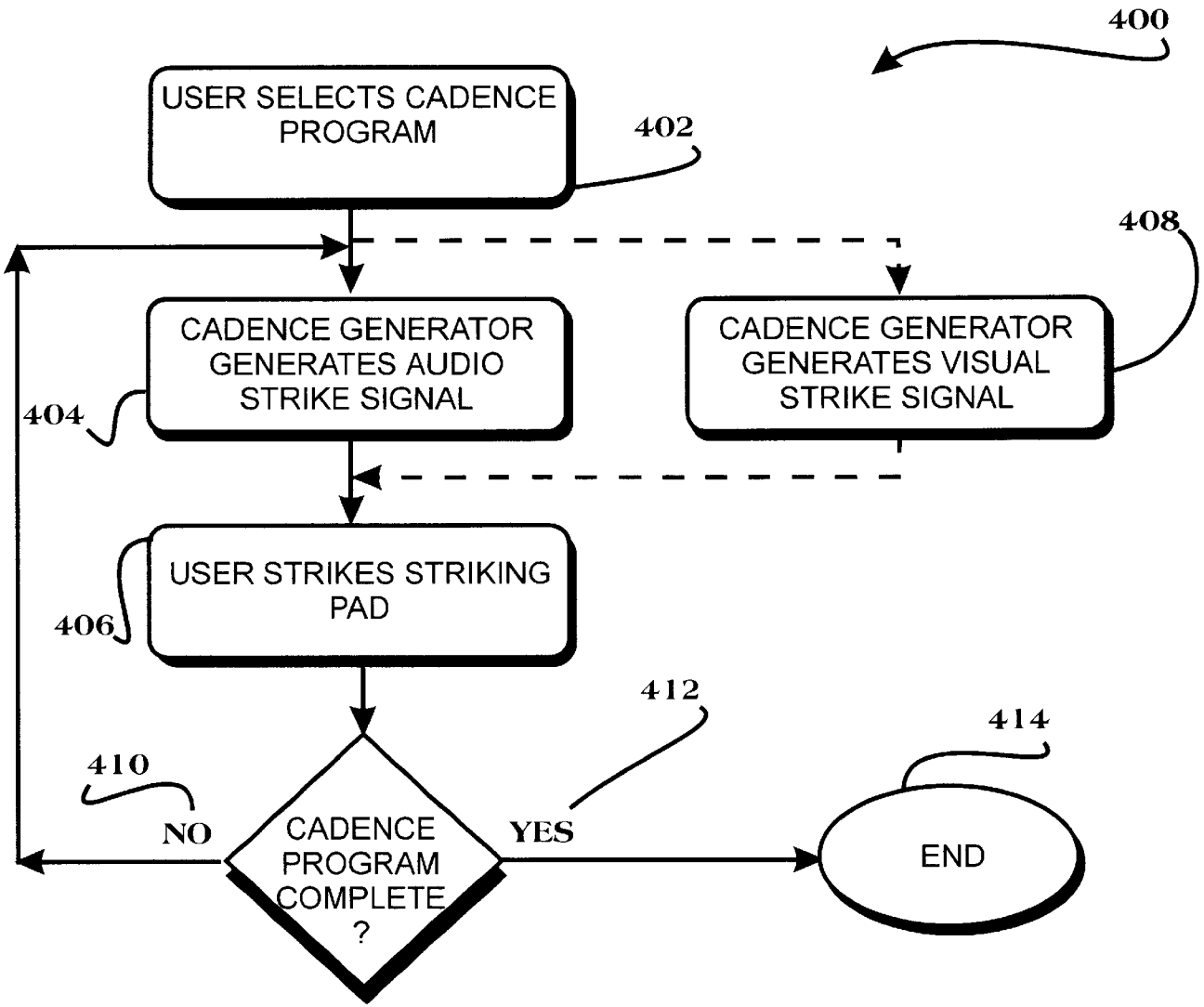
FIG. 4 depicts the operating method of the invention of the present invention.

The present invention can best be understood by initial consideration of FIG. 4. FIG. 4 depicts the operating method 400 of the invention of the present invention. Unlike the conventional practice pads and other devices described hereinabove, the present method commences with the user selecting a cadence program 402. The cadence program is selected from a repository of cadence programs, each resulting in a different combination of rudimentary drum strikes. Once the cadence program is selected by the user, the cadence generator (for example a "metronome") generates an audio strike signal 404 that is audibly perceptible to the human senses. In response to this audio signal, the user strikes a striking pad 406. Unlike the prior methods, then, in the present invention, the user strikes a pad in response to a single audio signal (rather than the user listening to a string of audio signals and then trying to imitate the entire string). Furthermore, it is an optional feature that the cadence generator generate a visual strike signal 408, coincidental with the audio strike signal, that is visually perceptible to the human senses.

If the cadence program has not been completed (or the system has not been manually stopped), 410, then the next audio/visual strike signal is generated. When the cadence program is completed (or the system is manually stopped) 412, then the system ends this routine 414, and the presentation of strike signals ceases. Now turning to FIG. 5, we can begin to examine the structure of the present invention.

Figure 5:
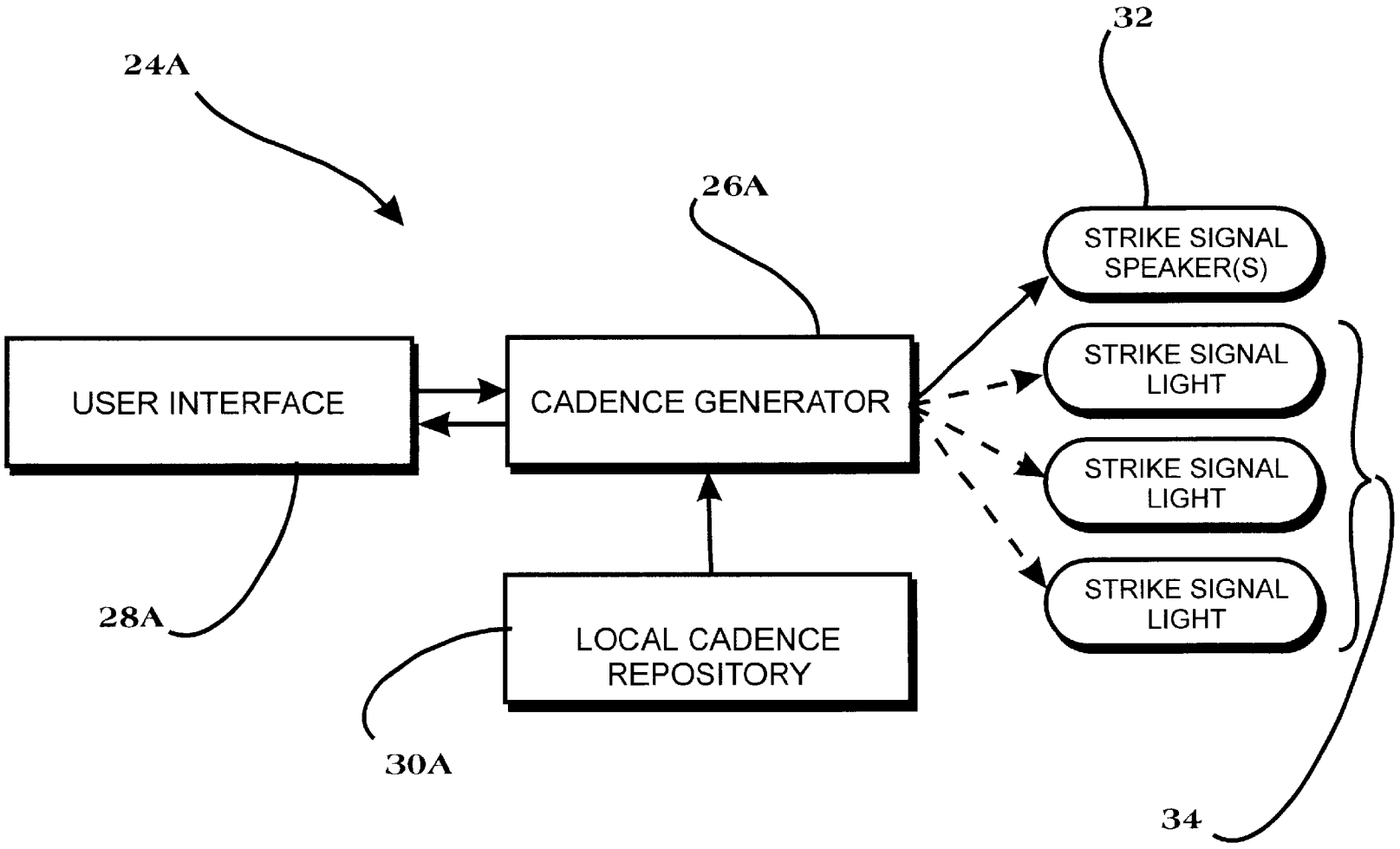
FIG. 5 depicts the functional arrangement of the components of a preferred embodiment of the Cadence-providing drum practice pad assembly of the present invention.

FIG. 5 depicts the functional arrangement of the components of a preferred embodiment of the Cadence-providing drum practice pad assembly 24A of the present invention. As shown in this functional diagram, the cadence generator 26A is controlled by a user interface 28A (which may actually be incorporated within the cadence generator logic), to permit the user to select a particular cadence program from a local cadence repository 30A. Once selected the cadence program is operated upon by the cadence generator 26A to provide audio sounds from one or more strike signal speakers 32, and possibly to provide visual sounds from one or more strike signal lights 34. As discussed above in connection with FIG. 4, the user is then expected to repeat each strike as prompted by the audio and visual signals. There are several embodiments of the present invention, another of which is shown in FIG. 6.

Figure 6:
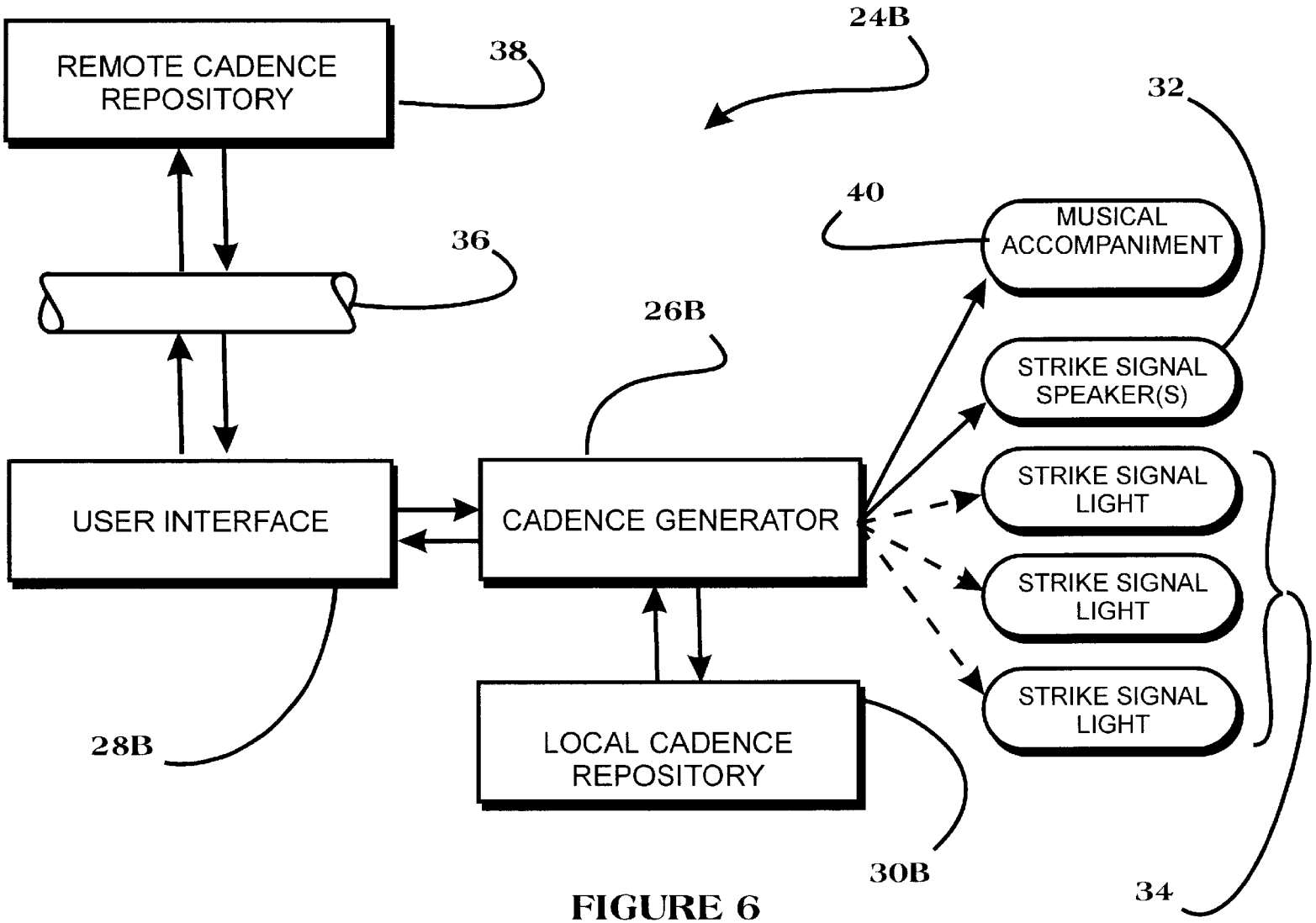
FIG. 6 depicts the functional arrangement of the components of an alternate embodiment of the Cadence-providing drum practice pad assembly of the present invention.

FIG. 6 depicts the functional arrangement of the components of an alternate embodiment of the Cadence-providing drum practice pad assembly 24B of the present invention. In this embodiment, the cadence generator 26B is controllable by the user interface 28B to potentially communicate with a remote cadence repository 38 via a network conduit 36 (e.g. the world-wide-web) to permit the user to obtain a wider variety of cadence programs. Cadence programs retrieved from the remote cadence repository 38 can then be stored in the local cadence repository 30B (for later presentation by the cadence generator), or might be operated upon immediately by the cadence generator 26B.

In this embodiment not only can the cadence generator drive strike signal speakers 32 and strike signal lights 34, but it may also provide musical accompaniment for the user through musical accompaniment speakers 40 (which might be the same device(s) as the strike signal speakers 32), or it might be sent to external output, similar to the conventional drum synthesizer. What should be understood is that the assembly 24B of this embodiment has the ability to accept cadence programs from external sources (even from a portable storage media, such as a "floppy disc"), and then execute these cadence programs to output through the speaker(s) and/or light(s). To understand the physical structure of the present invention, we shall now turn to FIG. 7.

Figure 7:
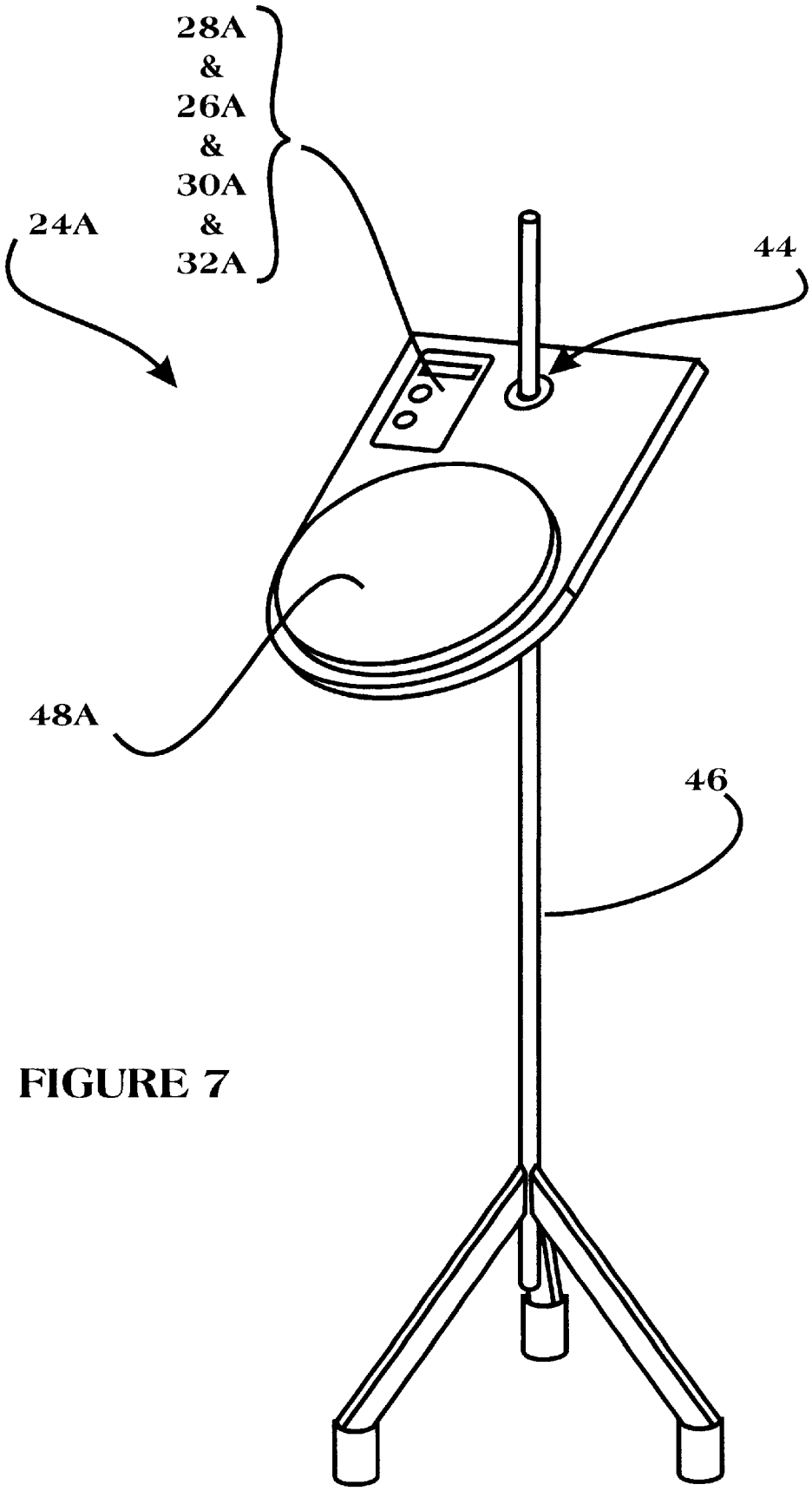
FIG. 7 is a perspective view of a preferred embodiment of the assembly of FIG. 5.

FIG. 7 is a perspective view of a preferred embodiment of the assembly 24A of FIG. 5. As shown, the assembly 24A comprises a base 42A, which is preferably formed with an aperture 44 therein for attachment to (or perching on) an external structure, such as the cymbal stand 46 shown (the user may alternatively choose to attach the assembly 24A to an actual drum stand). In this embodiment, a striking pad 48A is attached or formed on the base 42A to provide the user with a cushioned surface upon which he or she can strike their drum sticks. Also included in this embodiment is a single device that makes up the user interface 28A, the cadence generator 26A, the local cadence repository 30A and at least one strike signal speaker 32A. This assembly 24A is used as described herein above, namely the user selects a cadence program from the cadence repository 30A and sets the cadence generator 26A to present the desired cadence to the user for practice/training. If we turn to FIG. 8, we can examine yet another embodiment of the present invention.

Figure 8:
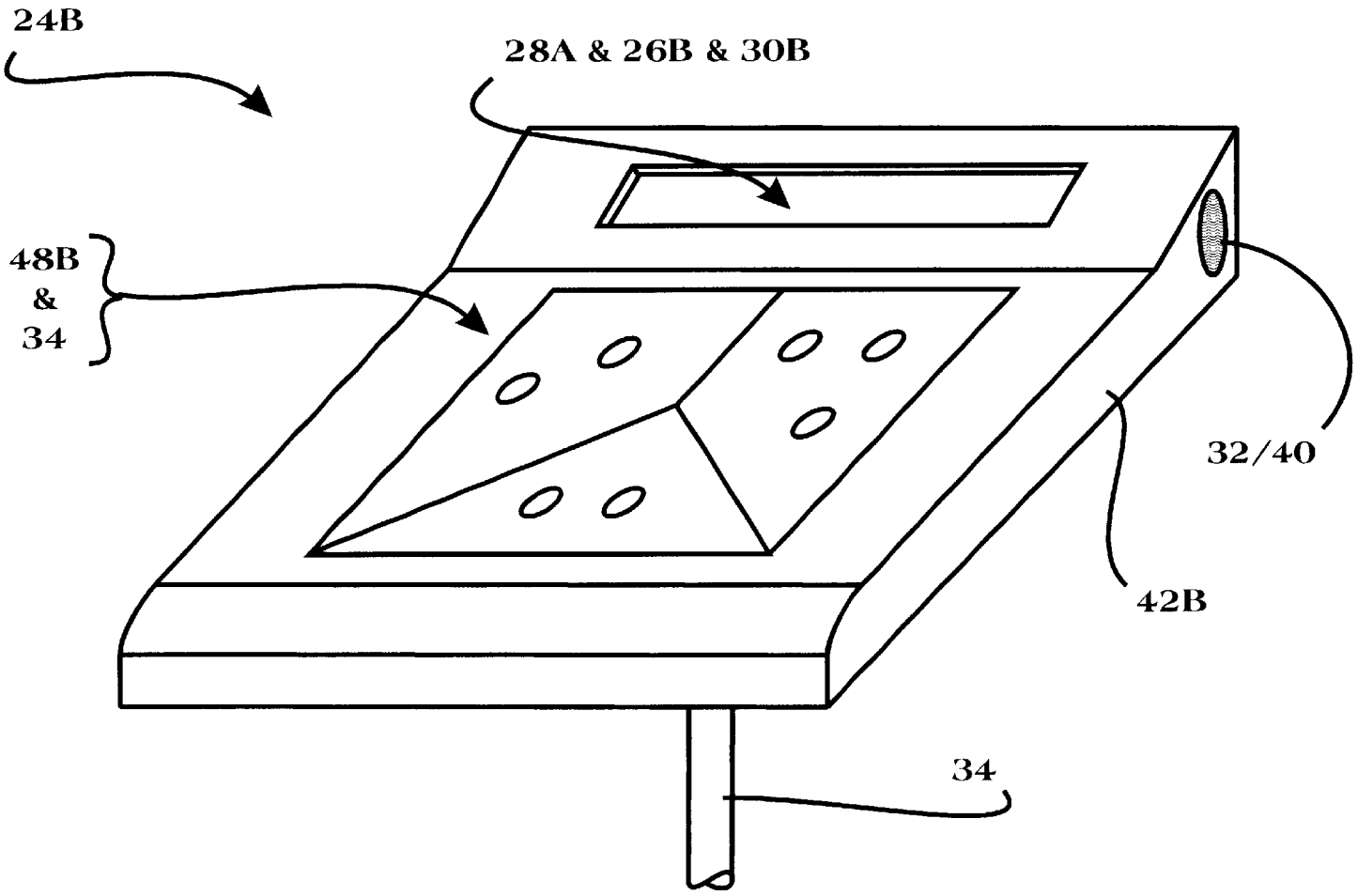
FIG. 8 is a perspective view of a preferred embodiment of the assembly of FIG. 6.

FIG. 8 is a perspective view of a preferred embodiment of the assembly 24B of FIG. 6. In this embodiment, the base 42B houses the electronics necessary to provide the functionality described above in connection with FIG. 6. Protruding from, (or flush with as shown here) the base 42B is the striking pad 48B; more detail related to the striking pad 48B is shown below in connection with FIGS. 9 and 10, however it is pointed out here that disbursed on the striking pad 48B is one or more of the strike signal lights 34 that were discussed above. When the cadence generator 26B presents a cadence to the user, and when the lights 34 are employed, it should be appreciated that the different lights disbursed on the face of the striking pad 48B can be selectively illuminated by the cadence generator to provide the user with specific, visual direction as to when and where to make his or her drum stick strike. This has been demonstrated to provide the user with a very powerful learning tool that uses the visual learning process (in addition to audio learning).

Other details shown in this FIG. 8 include the combined strike signal speaker 32 and musical accompaniment speaker 40; it should be understood that not every user or every training session will involve the user's playing of accompaniment music—should such music be desired, however, then the user can have it played by the assembly 24B. It should further be noted that this embodiment of the assembly 24B might also include an aperture formed in its base 42B in order to provide a means for perching it upon a cymbal stand 46.

Figure 9:
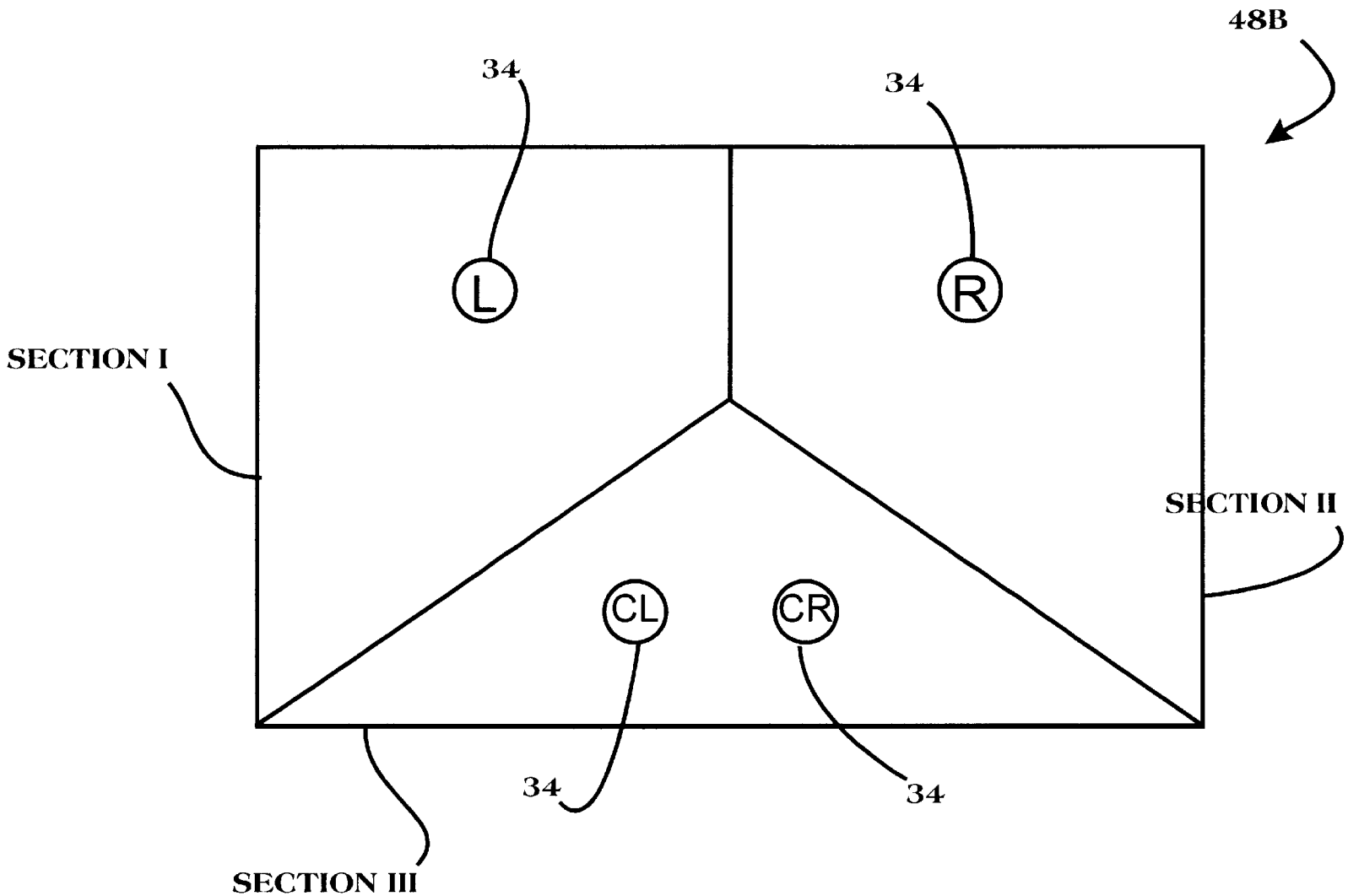
FIG. 9 is a top view of a preferred embodiment of a striking pad of the present invention.

FIG. 9 is a top view of a preferred embodiment of a striking pad 48B of the embodiment of FIGS. 6 and 8. As shown, the striking pad 48B is divided up into three sections (Sections I, II and III); these sections preferably have different colors, for example Section I being green, Section II being blue, and Section III being red. Disbursed across the Sections are a plurality of strike signal lights 34; these are preferably labeled as shown to indicate what sound might be coincidentally produced by the strike signal speaker. A complete table is provided below after a description of FIG. 10.

Figure 10:
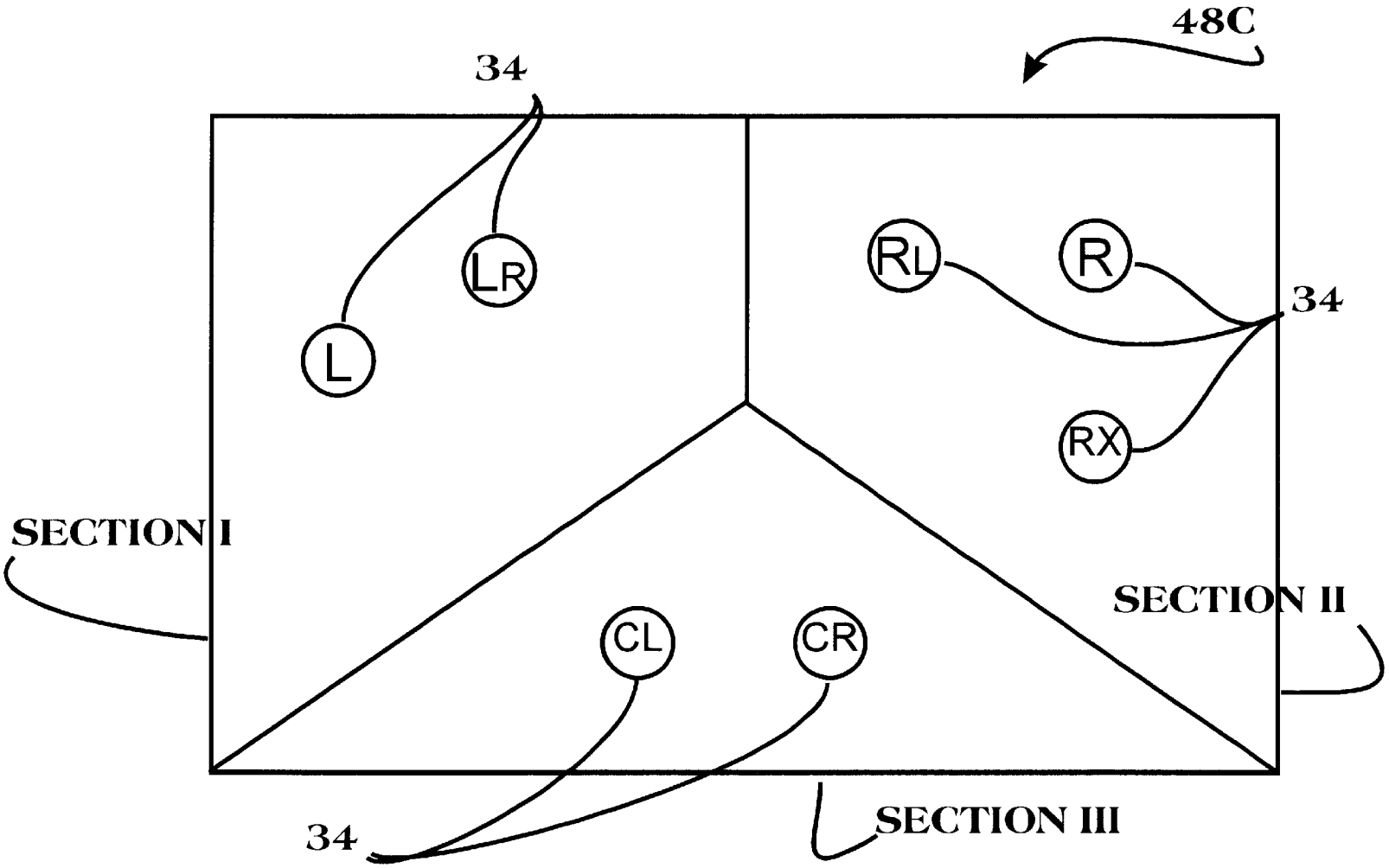
FIG. 10 is a top view of an alternate preferred embodiment of a striking pad of the present invention.

FIG. 10 is a top view of an alternate preferred embodiment 48C of a striking pad of the present invention of FIGS. 6 and 8. As can be seen, the strike signal lights 34 are labeled differently than in the previous embodiment; it should be understood that each assembly might include the possibility of changing the face of the striking pad 48 to provide a wide variety of configurations of light patterns and labels. An example of how the different labels might be used in a particular embodiment, the following table is provided:

TABLE I

L=left hand, sound 2;

R=right hand, sound 2;

CL=left hand, sound 2;

CR=right hand, sound 2;

$L_R$=left hand, sound 2;

$R_L$=right hand, sound 2; and

RX=right hand sound 1.

An example of a particular cadence in the format of Table I is: "Triple Paradidles" (a conventional rudimentary exercise):

CR, CL, CR, CL, CR, CL, R, R, CR, CL, CR, CL, CR, CL, L, L

Figure 11:
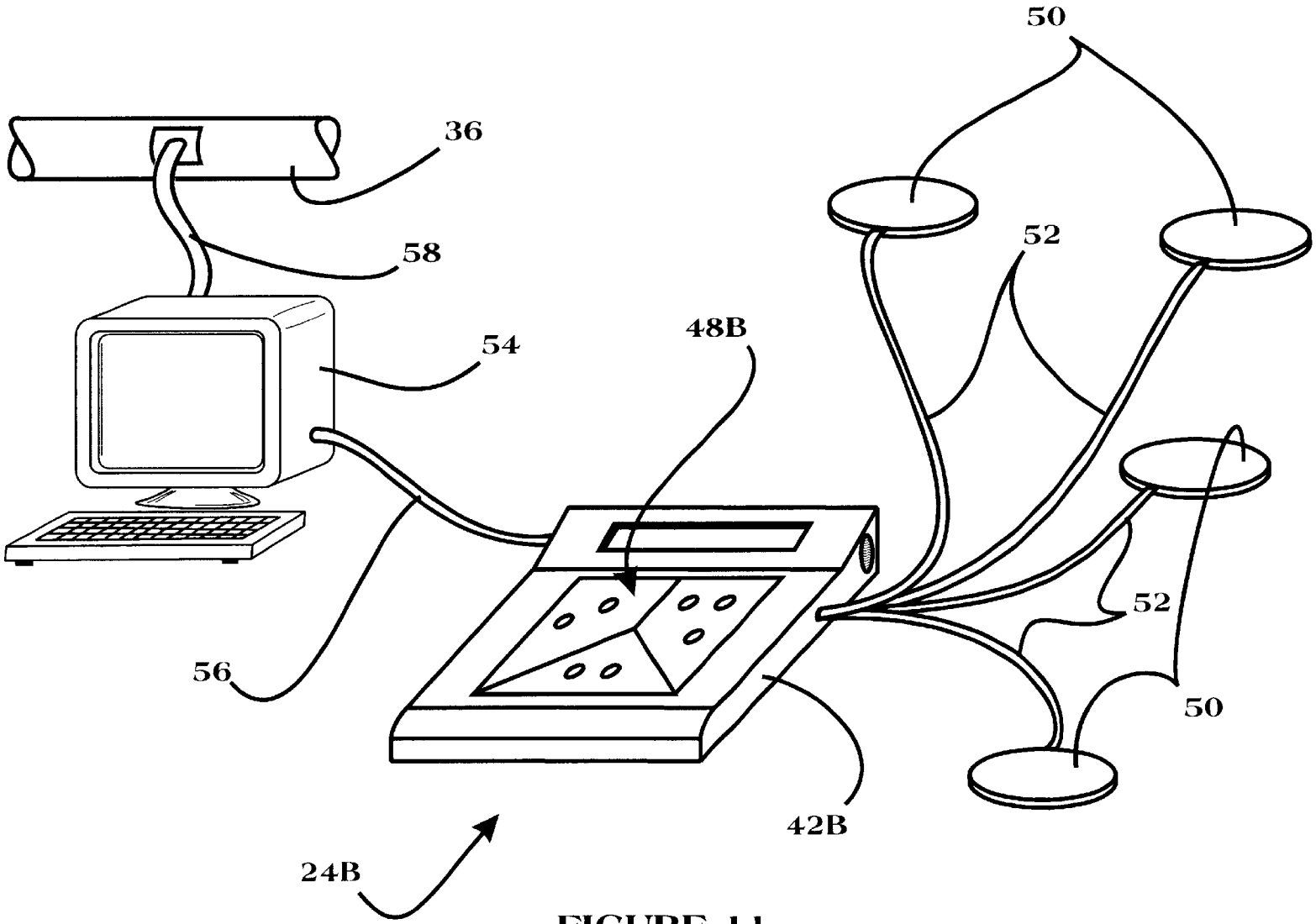
FIG. 11 is a perspective view of an alternate embodiment of the assembly of FIGS. 6 and 8.

FIG. 11 is a perspective view of yet another alternate embodiment of the assembly 24B of FIGS. 6 and 8. In this embodiment, the assembly includes a plurality of remote striking pads 50 that are each connected to the cadence generator by a lead 52 (the leads might be replaced by a wireless connection). The remote striking pads 50 are designed to be placed on surfaces that are remote to the striking pad 48B, such as on the drums of a drum set. These pads 50 will preferably provide remote strike light signals (and possibly audio strike signals) to the user (i.e. at the remote location), such that the user could use the is assembly 24B to train specifically on this or her actual drum set.

Figure 12:
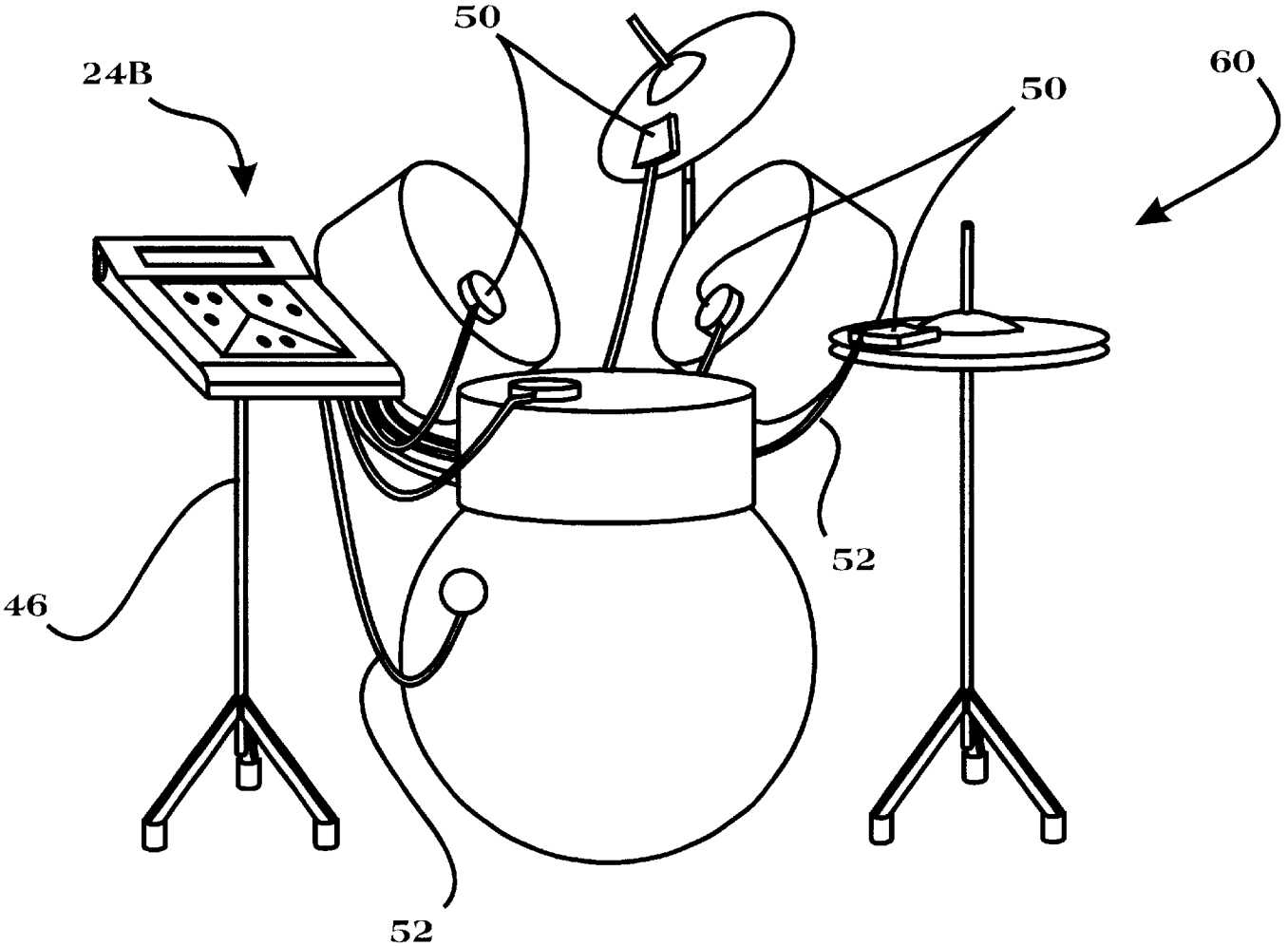
FIG. 12 is a perspective view of the assembly of FIG. 11 as it might be used with a conventional drum set.

Furthermore, and as shown, the assembly 24B might be connectable via a personal computer 54 and upload cable 56 and network connection 58 to a network conduit 36 (such as the world-wide web) to retrieve cadence programs (and possibly accompaniment music) from one or more remote cadence repositories. This improved system is shown in FIG. 12 as it might be installed on a conventional drum set 60.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cadence-providing drum practice pad assembly, comprising:

a cadence generator;

at least one strike signal speaker means for generating audible strike signals responsive to said cadence generator;

at least one striking pad; and at least one strike signal light means in communication with said cadence generator, said strike signal light means for generating visible strike signals responsive to said cadence generator.

2. The assembly of claim 1, further comprising:

a base including said cadence generator, said strike signal speaker means and each said striking pad.

3. The assembly of claim 2, further comprising:

a user interface means for enabling a user to operate said cadence generator; and a local cadence respository operatively connected to said cadence generator and said user interface means, said local cadence repository storing alternate cadence programs for selection by a user for execution by said cadence generator.

4. The assembly of claim 3, further comprising:

network conduit connection means for permitting said assembly to communicate via a computer network;

a remote cadence respository operatively connectable with said user interface via said network conduit connection means, said remote cadence repository storing alternate cadence programs for selection by a user for saving in said local cadence repository or for selection by a user for execution by said cadence generator.

5. The assembly of claim 4, wherein said striking pad comprises a translucent striking surface through which each said strike signal means is visible, said striking surface further comprising a blue-colored section, a red-colored section, and a green-colored section.

6. The assembly of claim 3 further comprising musical accompaniment speaker means for generating audible accompanying music for a user's enjoyment.

7. The assembly of claim 3, further comprising;

at least one remote striking pad in operative communication with said cadence generator, each said remote striking pad further including strike signal light generating means for generating visual strike signals responsive to said cadence generator.

8. The assembly of claim 7, further comprising at least one lead interconnecting one said remote striking pad with said cadence generator.

9. The assembly of claim 7 wherein each said remote prompting pad further comprises means for attaching said remote striking pad to a conventional percussion instrument.

10. The assembly of claim 1, further comprising:

network conduit connection means for permitting said assembly to communicate via a computer network; and a remote cadence respository operatively connectable with said user interface via said network conduit connection means, said remote cadence repository storing alternate cadence programs for selection by a user for saving in said local cadence repository or for selection by a user for execution by said cadence generator.

11. The assembly of claim 10 further comprising musical accompaniment speaker means for generating audible accompanying music for a user's enjoyment.

12. The assembly of claim 1 further comprising musical accompaniment speaker means for generating audible accompanying music for a user's enjoyment.

13. The assembly of claim 1, wherein said striking pad comprises a translucent striking surface through which each said strike signal light means is visible.

14. The assembly of claim 13, wherein said striking surface is comprised of at least three sections, each section displaying a color that differs from the other said sections.

15. The assembly of claim 14, wherein said striking surface comprises a blue-colored section, a red-colored section and a green-colored section.

16. An improved drum practice method, comprising the steps of:

a cadence selecting step wherein a user interacts with a user interface to select a percussion cadence for generation by a cadence generator;

an audio strike cadence generating step wherein said selected cadence is converted to an audible cadence generated by a cadence generator; and a visual strike cadence generating step wherein said selected cadence is converted to a visual cadence generated by said cadence generator a striking step, wherein a user strikes a surface responsive to said audible cadence.

17. The method of claim 16, wherein said cadence selecting step comprises a user interacting with a remote cadence repository over a wide-area computer network.

18. The method of claim 16 wherein said visual strike cadence generating step further comprises said selected cadence being converted to a remote visual cadence, said remote visual cadence being displayed by remote strike signal light generating means.

* * * * *